United States Patent [19]

Balzano et al.

[11] Patent Number: 4,800,395

[45] Date of Patent: Jan. 24, 1989

[54] HIGH EFFICIENCY HELICAL ANTENNA

[75] Inventors: Quirino Balzano, Plantation; Oscar M. Garay, North Lauderdale, both of Fla.

[73] Assignee: Motorola, Inc., Schaumburg, Ill.

[21] Appl. No.: 64,628

[22] Filed: Jun. 22, 1987

[51] Int. Cl.[4] ..... H01Q 1/36

[52] U.S. Cl. ..... 343/895; 343/790; 343/749

[58] Field of Search ..... 343/895, 790, 791, 792, 343/749, 752, 827

[56] References Cited

U.S. PATENT DOCUMENTS

| | | | |
|---|---|---|---|
| 2,895,130 | 7/1959 | Klancnik, Jr. | 343/747 |
| 4,121,218 | 10/1978 | Irwin et al. | 343/702 |
| 4,137,534 | 1/1979 | Goodnight | 343/895 |
| 4,138,681 | 2/1979 | Davidson et al. | 343/702 |
| 4,214,247 | 7/1980 | Richmond | 343/895 |
| 4,229,743 | 10/1980 | Vo et al. | 343/895 |
| 4,259,673 | 3/1981 | Guretsky | 343/825 |
| 4,309,707 | 1/1982 | James et al. | 343/895 |
| 4,442,438 | 4/1984 | Siwiak et al. | 343/895 |
| 4,543,581 | 9/1985 | Nemet | 343/702 |

FOREIGN PATENT DOCUMENTS

| | | | |
|---|---|---|---|
| 1277388 | 9/1968 | Fed. Rep. of Germany | 343/895 |

*Primary Examiner*—William L. Sikes
*Assistant Examiner*—Hoanganh Le
*Attorney, Agent, or Firm*—Mark P. Kahler; Martin J. McKinley

[57] ABSTRACT

An antenna is provided which includes a half wave helical element RF coupled to a monopole element. The monopole element is situated on the axis of the helical element and extends into the helical element a distance sufficient to permit resonant coupling between the helical element and the monopole element. The monopole element is driven by a source of radio frequency energy such that the helical element coupled thereto is excited by such radio frequency energy.

6 Claims, 1 Drawing Sheet

—PRIOR ART—

—PRIOR ART—

HIGH EFFICIENCY HELICAL ANTENNA

BACKGROUND OF THE INVENTION

This invention relates in general to antennas for radiating electromagnetic signals. More particularly, the invention relates to helical antennas for portable radios and other communications equipment.

One conventional helical antenna is shown in FIG. 1 as antenna 10. Antenna 10 is a simple quarter wave (λ/4) structure consisting of a quarter wave helical element 15 coupled to a radio frequency (RF) output 20 mounted on radio case 25. λ is defined as the wavelength corresponding to the desired center frequency of antenna 10. Functionally, such a structure may be viewed as an asymmetric dipole in which the helical element 15 is one element and radio case 25 is the other element. In one typical configuration of the antenna of FIG. 1, helical element 15 contributes approximately 6 ohms to the impedance of the antenna and radio case 25 contributes approximately 44 ohms to the antenna impedance. The impedance contributed by radio case 25 includes both the radiation resistance of case 25 and the ohmic losses due to RF currents in and on case 25. Thus, the overall impedance of a quarter wave helical element situated above a radio, such as in the example of antenna 10 above radio case 25, is approximately 50 ohms. This 50 ohm antenna impedance is conveniently matched with the 50 ohm impedance of radio output 20. In this conventional quarter wave helical antenna, there is a direct physical connection between helical element 15 and output 20 of the radio. Unfortunately, with this approach, relatively high RF currents flow in radio case 25. Thus, when the radio user touches the radio case 25 while operating the radio, the user dissipates these RF currents so as to undesirably decrease the strength of the radiated signal.

Those skilled in the art appreciate that it is generally desirable to have high RF currents in the antenna of a portable radio in order to transmit the strongest signal possible. One way to excite such high currents is with a resonant half-wave helical antenna 30 as shown in FIG. 2. In antenna 30 a quarter wave transmission line transformer 35 is used to directly couple the radio RF output 20 to one end of a half wave (λ/2) resonant element 40. Unfortunately, although high levels of RF current are generated in such an antenna, a large RF current is still excited in radio case 25. Thus, as in the case of the quarter wave helical antenna of FIG. 1, the performance of antenna 30 is degraded when the user touches the radio case 25.

BRIEF SUMMARY OF THE INVENTION

One object of the present invention is to provide an antenna which performs with no significant degradation when the radio user touches the radio on which the antenna is mounted.

Another object of the invention is to provide an antenna which is highly efficient.

Yet another object of the present invention is to provide an antenna having relatively compact dimensions.

In one embodiment of the invention, an antenna is provided which includes a helical element exhibiting an electrical length approximately equal to the ½ wavelength corresponding to a selected center frequency. The antenna further includes a monopole element having opposed ends. One end of the monopole element extends into the helical element to a predetermined distance sufficient to cause resonant coupling between the monopole element and the helical element. The remaining end of the monopole element is adapted to be driven by a source of radio frequency energy.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
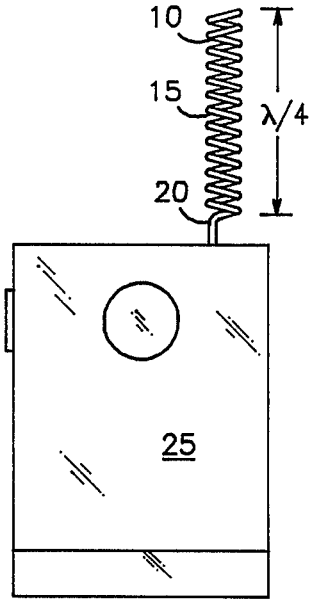
FIG. 1 is a representation of a conventional quarter wave helical antenna coupled to a portable radio.
Figure 2:
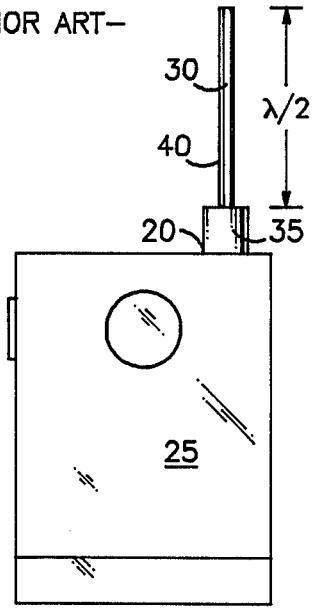
FIG. 2 is a representation of a conventional half wave helical antenna coupled to a portable radio.
Figure 3:
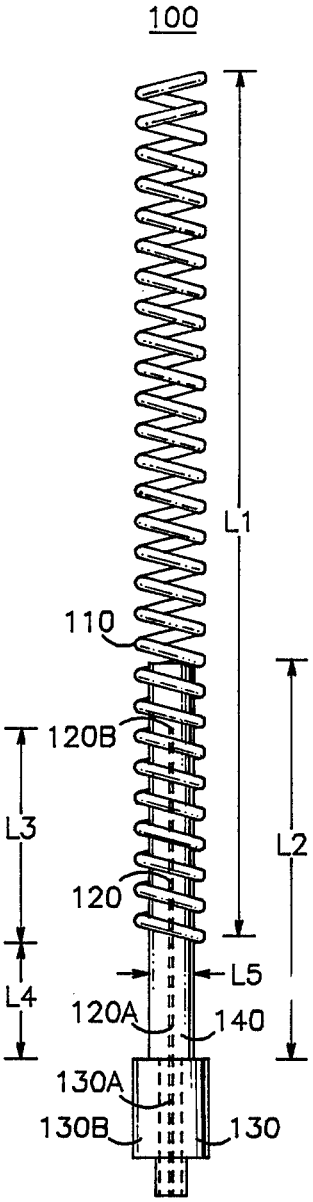
FIG. 3 is a representation of the helical antenna of the present invention.

Turning now to FIG. 3, one embodiment of the antenna of the present invention is shown as antenna 100. Antenna 100 includes a helical element 110 which exhibits an electrical length approximately equal to one half the wavelength corresponding to the desired center frequency for the antenna. Although the particular antenna disclosed herein operates in the VHF band and exhibits a center frequency of 160 MHz, those skilled in the art will appreciate that the dimensions which follow are given for purposes of example and may be scaled up or down so that the antenna of the invention will operate in other frequency ranges as well.

In this particular embodiment of the invention, helical element 110 exhibits a pitch of approximately 4 turns per cm and a physical length L1 which is approximately equal to 13 cm. Those skilled in the art appreciate that the pitch and physical length L1 of element 110 can be changed from the examples given above and yet still have element 110 resonate at the above stated center frequency. Those skilled in the art will also appreciate that the pitch and length L1 of element 110 can also be altered to cause antenna 100 to resonate frequencies other than the particular 160 MHz center frequency of this example.

Antenna 100 further includes a monopole element 120 which exhibits a length L2 substantially less than one quarter of the wavelength corresponding to the selected center frequency of antenna 100. For example, in the present example wherein the center frequency is equal to approximately 160 MHz, which corresponds to a wavelength of 187 cm, the length L2 of monopole 120 is approximately 5 cm.

Monopole element 120 includes opposed ends 120A and 120B. Monopole end 120A is coupled to the center conductor portion 130A of coaxial connector 130. The center conductor portion 130A is adapted to be coupled to the RF output of a radio. Coaxial connector 130 also includes a ground portion 130B which is adapted to be coupled to the radio case (not shown in FIG. 3). Monopole element 120 is situated coaxially with respect to helical element 110. The remaining monopole end 120B extends into helical element 110 a sufficient distance to resonantly coupled thereto. For example, in this embodiment of the invention, monopole element 120 extends into helical element 110 a distance L3 approximately equal to ¼ of the physical length L1 of helical element 110. That is, L3 is approximately equal to 3.25 cm. The term "resonant coupling" as used herein includes both capacitive coupling and inductive coupling.

A cylindrical dielectric spacer 140 is situated over monopole element 120 as shown in FIG. 3. In this embodiment, spacer 140 is shaped in the form of a hollow tube inside of which monopole element 120 is situated. Spacer 140 is fabricated from low dielectric constant materials such as plastic, insulative shrink tubing material, Teflon TM material or other similar electrically insulative materials. Spacer 140 assures that monopole element 120 does not directly contact helical element 110. As seen in FIG. 3, helical element 110 is wound over a portion of spacer 140 to permit the desired coupling between helical element 110 and monopole element 120 as described above.

Helical element 110 is spaced apart from coaxial connector 130 by a length L4 sufficiently long to avoid capacitive coupling between helical element 110 and a radio case (not shown) or other structure into which coaxial connector 130 is inserted. In the present example, it was found that for antenna 100, a distance L4 of approximately 1.8 cm between helical element 110 and coaxial connector 130 is sufficient to prevent substantial capacitive coupling between helical element 110 and a radio case attached to coaxial connector 130. Those skilled in the art will appreciate that the value selected for L4 will depend on the frequency selected as the center frequency of antenna 100. The actual value selected for L4 may be more than or less than the example given as long as the above mentioned coupling criteria are met.

In the example of antenna shown in FIG. 3, the outer diameter L5 of spacer 140 is approximately equal to 0.6 cm. The thickness (outer diameter minus inner diameter) of spacer 140 is approximately equal to 1.5 mm and is selected to keep monopole element 120 on the axis of helical element 110. It is noted that in FIG. 3, monopole element 120 is on the same axis as helical element 110.

When antenna 100 is connected to the output of a radio via coaxial connector 130, substantially smaller RF currents flow in the radio case than when many conventional antennas are used. Thus, when the radio user touches the radio to which antenna 100 is connected, the user tends to absorb less RF current than is the case with conventional antennas. For this reason, antenna 100 exhibits comparatively less performance degradation when the user touches the radio.

The foregoing describes an antenna in which performance is not significantly degraded when the radio user touches the radio on which the antenna is mounted. The antenna exhibits high efficiency and relatively compact size.

While only certain preferred features of the invention have been shown by way of illustration, many modifications and changes will occur to those skilled in the art. It is, therefore, to be understood that the present claims are intended to cover all such modifications and changes which fall within the true spirit of the invention.

We claim:

1. An antenna comprising:

a helical element exhibiting an electrical length approximately equal to $\frac{1}{2}$ wavelength at a selected center frequency, said helical element also exhibiting a physical length, and a monopole element having opposed ends, one end of which extends into said helical element a predetermined distance sufficient to cause resonant coupling between said monopole element and said helical element, said predetermined distance being substantially less than the physical length of said helical element, the remaining end of said monopole element being connectable to a source of radio frequency energy.

2. The antenna of claim 1 including a spacer coaxially situated between said helical element and said monopole element to insulate said helical element from said monopole element.

3. The antenna of claim 2 wherein said coaxial connector and said helical element are separated by a distance sufficient to substantially eliminate undesired coupling between said helical element and said source of radio frequency energy.

4. The antenna of claim 1 including a coaxial connector having a center conductor portion and a ground portion, said center conductor portion being coupled to the remaining end of said monopole element.

5. An antenna comprising:

a helical element exhibiting an electrical length approximately equal to $\frac{1}{2}$ wavelength at a selected center frequency, said helical element also exhibiting a physical length, and a monopole element having opposed ends, one end of which extends into said helical element a predetermined distance equal approximately one fourth the physical length of said helical element, said predetermined distance being sufficiently long to cause resonant coupling between said monopole and said helical element, the remaining end of said monopole element being connectable to a source of radio frequency energy.

6. An antenna comprising:

a helical element exhibiting an electrical length approximately equal to $\frac{1}{2}$ wavelength at a selected center frequency, said helical element also exhibiting a physical length, and a monopole element having opposed ends, one end of which extends into said helical element a predetermined distance sufficient to cause resonant coupling between said monopole element and said helical element, said predetermined distance being substantially less than the physical length of said helical element, the remaining end of said monopole element being connectable to a source of radio frequency energy, said monopole element being ohmically insulated from said helical element.

* * * * *